US010066276B2

(12) United States Patent
Pham et al.

(10) Patent No.: US 10,066,276 B2
(45) Date of Patent: Sep. 4, 2018

(54) HIGH THERMAL STABILITY BULK METALLIC GLASS IN THE ZR—NB—CU—NI—AL SYSTEM

(75) Inventors: Quoc Tran Pham, Anaheim, CA (US); Theodore A. Waniuk, Lake Forest, CA (US)

(73) Assignee: Crucible Intellectual Property, LLC, Rancho Santa Margarita, CA (US)

( * ) Notice: Subject to any disclaimer, the term of this patent is extended or adjusted under 35 U.S.C. 154(b) by 509 days.

(21) Appl. No.: 13/532,233

(22) Filed: Jun. 25, 2012

(65) Prior Publication Data

US 2013/0340897 A1 Dec. 26, 2013

(51) Int. Cl.
*C22C 1/02* (2006.01)
*C22C 45/00* (2006.01)
*C22C 45/10* (2006.01)

(52) U.S. Cl.
CPC ..... *C22C 1/02* (2013.01)

(58) Field of Classification Search
CPC ..... C22C 45/00; C22C 45/10; C22C 1/02
USPC ..... 148/561
See application file for complete search history.

(56) References Cited

U.S. PATENT DOCUMENTS 5,368,659 A * 11/1994 Peker et al. ..... 148/403
6,447,550 B1 9/2002 Hunter et al.
6,585,772 B2 7/2003 Hunter et al.
6,592,689 B2 7/2003 Hays
7,473,278 B2 1/2009 Hunter et al.
7,582,117 B2 9/2009 Hunter et al.
7,896,926 B2 3/2011 Hunter et al.
7,968,209 B2 6/2011 Pawar et al.
8,556,987 B2 10/2013 Hunter et al.

FOREIGN PATENT DOCUMENTS

CN 1 417 369 5/2003
WO 2004/012620 2/2004

OTHER PUBLICATIONS

Inoue, A., T. Shibata, and T. Zhang (1995). Effect of additional elements on glass transition behavior and glass formation tendency of Zr—Al—Cu—Ni alloys. Mater. Trans., JIM 36: 1420-1426.*
International Search Report and Written Opinion, dated Oct. 16, 2013, PCT/ISA/210, PCT/ISA/220, and PCT/ISA/237, total of 9 pages.

* cited by examiner

*Primary Examiner* — Colleen P Dunn
*Assistant Examiner* — Anthony M Liang
(74) *Attorney, Agent, or Firm* — Brownstein Hyatt Farber Schreck, LLP

(57) ABSTRACT

Disclosed is an improved bulk metallic glass alloy and methods of making the alloy in which the alloy has the structure $Zr_aNb_bCu_cNi_dAl_e$, wherein a-e represent the atomic percentage of each respective element, and wherein b/a is less than about 0.040, and c/d is less than 1.15. The bulk metallic glass alloy has improved thermal stability and an increased super cooled liquid region rendering it capable of being thermoplastically formed into a variety of shapes and sizes.

2 Claims, 1 Drawing Sheet

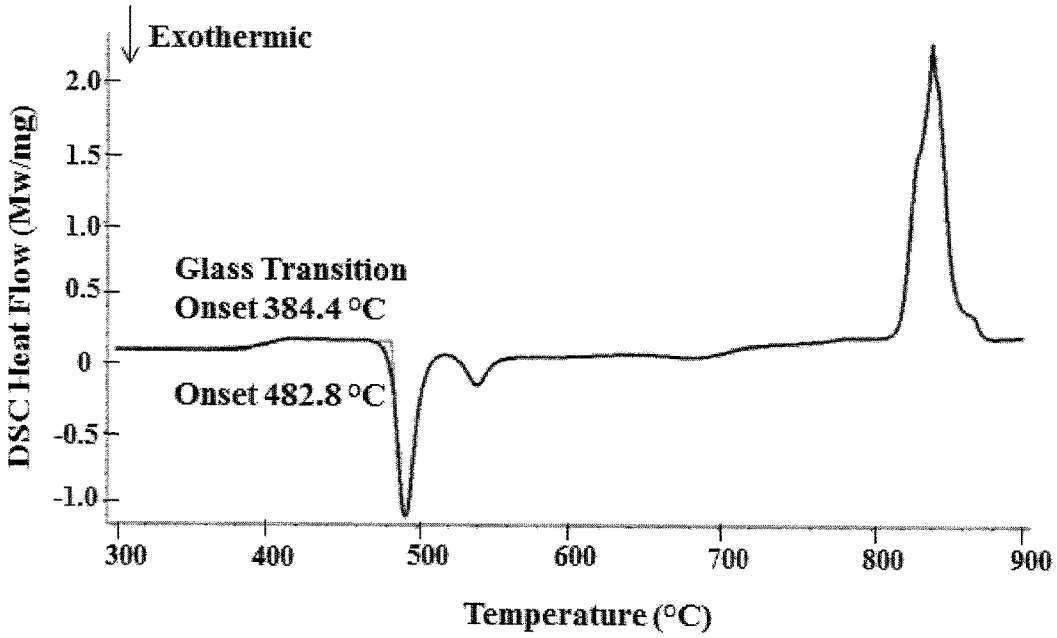
Exothermic
DSC Heat Flow (Mw/mg)
2.0
1.5
1.0
0.5
0
-0.5
-1.0
Glass Transition
Onset 384.4 °C
Onset 482.8 °C
300
400
500
600
700
800
900
Temperature (°C)

HIGH THERMAL STABILITY BULK METALLIC GLASS IN THE ZR—NB—CU—NI—AL SYSTEM

BACKGROUND

Field

The present disclosure is related generally to a bulk metallic glass (BMG) in the Zr—Nb—Cu—Ni—Al system having improved thermal stability making it more readily processible and more suitable for thermoplastic forming operations.

Description of Related Art

A glass is a material that when cooled from a heated liquid transforms to the solid state without forming crystals. Such non-crystallized materials are also called amorphous materials. For example, one of the better known amorphous materials is quartz, which can be used to form conventional window glass. Most metals crystallize when they are cooled from the liquid state at reasonable rates, which causes their atoms to be arranged into a highly regular spatial pattern or lattice. A metallic glass is one in which the individual metal atoms have settled into an essentially random arrangement. Metallic glasses are not transparent like quartz glasses and are often less brittle than window glass.

A number of simple metal alloys may also be processed to form a glass-like structure. Binary metal alloys near deep eutectic features of the corresponding binary phase diagrams may be prepared into a glassy structure on cooling from the liquid state at rates greater than 1000 degrees per second. These binary metallic glasses may possess different properties than crystalline metals. These different properties may be useful in certain applications.

Bulk metallic glass forming alloys (BMG) are a group of multi-component metallic alloys that exhibit exceptionally high resistance to crystallization in the undercooled liquid state. Compared with the rapidly quenched binary metallic glasses studied prior to 1990, these alloys can be vitrified at far lower cooling rates, less than 10 degrees per second. Many of the recently discovered BMG alloys can be broadly described as pseudo-ternary alloys of the form ETM1-x-yLTMxSMy. Typically the early transition metal couple, ETM, is a combination of elements from group IVB of the periodic table; e.g., Zr and Ti. The late transition metals, LTM, are typically combinations of the 3d transition metals from groups VIIIB and IB; e.g., Fe, Co, Ni, and Cu. The simple metal element, SM, is normally chosen groups from IIA or IIIA; e.g., Be, Mg or Al. However, the addition of a SM element is not a requirement for the formation of a bulk glass forming alloy.

Examples of some of the compositions that contain bulk metallic forming compositions are as follows: Zr—Ti—Cu—Ni—Be, Zr—Nb—Cu—Ni—Al, Ti—Zr—Cu—Ni, and Mg—Y—Cu—Ni—Li. There are also bulk metallic glass forming alloys based on magnesium and molybdenum. Each of the chemical species and their combinations are selected for a given alloy composition, such that the alloy composition lies in a region with low-lying liquidus surface. Alloy compositions that exhibit a high glass forming ability (GFA) are generally located in proximity to deep eutectic features in the multi component phase diagram.

The glass forming ability of a given alloy is in part described by the critical cooling rate that is required to avoid a fraction of crystal which is either large enough to be detectable, or large enough to cause some change of property. The glass forming ability is generally considered higher if the alloy composition has a reduced glass transition temperature. The reduced glass transition temperature is defined as the ratio between the glass transition temperature Tg to the liquidus temperature Tliq (Trg).

Early theoretical work on crystallization of undercooled liquid metals has showed that the nucleation rate was often vanishingly small for materials with Trg of approximately ⅔. Bulk metallic glass alloys can be more easily formed if the eutectic like condition is satisfied. Many believe that the alloy should be close to a eutectic in order to obtain a high Trg.

SUMMARY

One aspect of the disclosure provides a bulk metallic glass (BMG) in the Zr—Nb—Cu—Ni—Al system having improved thermal stability making it more readily processible and more suitable for thermoplastic forming operations. In accordance with one embodiment, there is provided a bulk metallic glass composition comprising $Zr_aNb_bCu_cNi_dAl_e$, wherein a-e represent the atomic percentage of each respective element, and wherein b/a is less than about 0.040, and c/d is less than 1.15. Another embodiment provides a bulk metallic glass alloy having the composition $Zr_{61.45}Nb_{1.75}Cu_{13.5}Ni_{12.6}Al_{10.0}$.

Another embodiment provides a method of forming a bulk metallic glass alloy by forming a bulk metallic glass of the following composition $Zr_aNb_bCu_cNi_dAl_e$, wherein a-e represent the atomic percentage of each respective element, by adjusting the ratio of b/a to less than about 0.040, and adjusting the ratio of c to d to less than about 1.15.

Other features and advantages of the present disclosure will become apparent from the following detailed description and the appended claims.

BRIEF DESCRIPTION OF THE DRAWINGS

FIG. 1 depicts a DSC (i.e., differential scanning calorimetry) thermogram of an exemplary alloy containing $Nb_{1.75}$ in accordance with various embodiments of the present teachings.

DETAILED DESCRIPTION

The methods, techniques, and devices illustrated herein are not intended to be limited to the illustrated embodiments. All publications, patents, and patent applications cited in this Specification are hereby incorporated by reference in their entirety.

The articles "a" and "an" are used herein to refer to one or to more than one (i.e., to at least one) of the grammatical object of the article. By way of example, "an alloy" means one alloy or more than one alloy. Any ranges cited herein are inclusive. The terms "substantially" and "about" used throughout this specification are used to describe and account for small fluctuations. For example, they can refer to less than or equal to ±5%, such as less than or equal to ±2%, such as less than or equal to ±1%, such as less than or equal to ±0.5%, such as less than or equal to ±0.2%, such as less than or equal to ±0.1%, such as less than or equal to ±0.05%.

The properties of the bulk metallic glass alloy make it particularly suitable for the methods of the embodiments. The alloys have high hardness, high elongation providing an ability to stretch and return to its original shape without plastic deformation, high yield strength, and the difference between the glass transition temperature Tg, and crystallization temperature Tx, (ΔT), or super cooled liquid region is high, thus providing a large window for thermoforming the bulk-solidifying amorphous alloy.

The bulk metallic glass alloy useful in the embodiments can have several characteristic temperatures, including glass transition temperature Tg, crystallization temperature Tx, and melting temperature Tm. In some embodiments, each of Tg, Tx, and Tm, can refer to a temperature range, instead of a discrete value; thus, in some embodiments the term glass transition temperature, crystallization temperature, and melting temperature are used interchangeably with glass transition temperature range, crystallization temperature range, and melting temperature range, respectively. These temperatures are commonly known and can be measured by different techniques, one of which is Differential Scanning calorimetry (DSC), which can be carried out at a heating rate of, for example, about 20° C./min.

In one embodiment, as the temperature increases, the glass transition temperature Tg of an amorphous alloy can refer to the temperature, or temperature ranges in some embodiments, at which the amorphous alloy begins to soften and the atoms become mobile. An amorphous alloy can have a higher heat capacity above the glass transition temperature than it does below the temperature, and thus this transition can allow the identification of Tg. With increasing temperature, the amorphous alloy can reach a crystallization temperature Tx, at which crystals begin to form. As crystallization in some embodiments is generally an exothermic reaction, crystallization can be observed as a dip in a DSC curve and Tx can be determined as the minimum temperature of that dip. An exemplary Tx for a Vitreloy can be, for example, about 500° C., that for a platinum-based amorphous alloy can be, for example, about 300° C., and for conventional Zr—Nb—Cu—Ni—Al alloys (referred to as A3 and A3a in U.S. Pat. No. 6,592,689, the disclosure of which is incorporated by reference herein in its entirety), for which the present embodiments represent an improvement, Tx can be about 500° C. For other alloy systems, the Tx can be higher or lower. It is noted that at the Tx, the amorphous alloy is generally not melting or melted, as Tx is generally below Tm.

Finally, as the temperature continues to increase, at the melting temperature Tm, the melting of the crystals can begin. Melting is an endothermic reaction, wherein heat is used to melt the crystal with minimal temperature change until the crystals are melted into a liquid phase. Accordingly, a melting transition can resemble a peak on a DSC curve, and Tm can be observed as the temperature at the maximum of the peak. For an amorphous alloy, the temperature difference ΔT between Tx and Tg can be used to denote a supercritical region (i.e., a "supercritical liquid region," or a "super cooled liquid region," as described in U.S. Pat. No. 6,669,793, the disclosure of which is incorporated by reference herein in its entirety), wherein at least a portion of the amorphous alloy retains and exhibits characteristics of an amorphous alloy, as opposed to a crystalline alloy. The portion can vary, including at least 40 wt %, at least 50 wt %, at least 60 wt %, at least 70 wt %, at least 80 wt %, at least 90 wt %, at least 99 wt %; or these percentages can be volume percentages instead of weight percentages. In an embodiment, the temperature difference ΔT is within the range of from about 80 to about 250° C., or from about 90 to about 150° C., or from about 95 to about 110° C. These high values for ΔT render the alloy more thermally stable, and more capable of processing using thermoplastic forming operations because the operating window is that much greater, when compared to a conventional Zr—Nb—Cu—Ni—Al alloy, which has a ΔT on the order of about 70° C.

Bulk-solidifying amorphous alloys, or bulk metallic glasses ("BMG"), are a recently developed class of metallic materials. These alloys may be solidified and cooled at relatively slow rates, and they retain the amorphous, non-crystalline (i.e., glassy) state at room temperature. Amorphous alloys have many superior properties than their crystalline counterparts. However, if the cooling rate is not sufficiently high, crystals may form inside the alloy during cooling, so that the benefits of the amorphous state can be lost. For example, one challenge with the fabrication of bulk amorphous alloy parts is partial crystallization of the parts due to either slow cooling or impurities in the raw alloy material. As a high degree of amorphicity (and, conversely, a low degree of crystallinity) is desirable in BMG parts, there is a need to provide BMG alloys having controlled amount of amorphicity.

The supercooled liquid region, the temperature region between Tg and Tx is a manifestation of the extraordinary stability against crystallization of bulk metallic glass alloys. In this temperature region the bulk solidifying alloy can exist as a high viscous liquid. The viscosity of the bulk metallic glass alloy in the supercooled liquid region can vary between $10^{12}$ Pa s at the glass transition temperature down to $10^{5}$ Pa s at the crystallization temperature, the high temperature limit of the supercooled liquid region. Liquids with such viscosities can undergo substantial plastic strain under an applied pressure. The embodiments herein make use of the large plastic formability in the supercooled liquid region as a forming and separating method.

Phase

The term "phase" herein can refer to one that can be found in a thermodynamic phase diagram. A phase is a region of space (e.g., a thermodynamic system) throughout which all physical properties of a material are essentially uniform. Examples of physical properties include density, index of refraction, chemical composition and lattice periodicity. A simple description of a phase is a region of material that is chemically uniform, physically distinct, and/or mechanically separable. For example, in a system consisting of ice and water in a glass jar, the ice cubes are one phase, the water is a second phase, and the humid air over the water is a third phase. The glass of the jar is another separate phase. A phase can refer to a solid solution, which can be a binary, tertiary, quaternary, or more, solution, or a compound, such as an intermetallic compound. As another example, an amorphous phase is distinct from a crystalline phase.

Metal, Transition Metal, and Non-Metal

The term "metal" refers to an electropositive chemical element. The term "element" in this Specification refers generally to an element that can be found in a Periodic Table. Physically, a metal atom in the ground state contains a partially filled band with an empty state close to an occupied state. The term "transition metal" is any of the metallic elements within Groups 3 to 12 in the Periodic Table that have an incomplete inner electron shell and that serve as transitional links between the most and the least electropositive in a series of elements. Transition metals are characterized by multiple valences, colored compounds, and the ability to form stable complex ions. The term "nonmetal" refers to a chemical element that does not have the capacity to lose electrons and form a positive ion.

Depending on the application, any suitable nonmetal elements, or their combinations, can be used. The alloy (or "alloy composition") can comprise multiple nonmetal elements, such as at least two, at least three, at least four, or more, nonmetal elements. A nonmetal element can be any element that is found in Groups 13-17 in the Periodic Table.

For example, a nonmetal element can be any one of F, Cl, Br, I, At, O, S, Se, Te, Po, N, P, As, Sb, Bi, C, Si, Ge, Sn, Pb, and B. Occasionally, a nonmetal element can also refer to certain metalloids (e.g., B, Si, Ge, As, Sb, Te, and Po) in Groups 13-17. In one embodiment, the nonmetal elements can include B, Si, C, P, or combinations thereof. Accordingly, for example, the alloy can comprise a boride, a carbide, or both.

A transition metal element can be any of scandium, titanium, vanadium, chromium, manganese, iron, cobalt, nickel, copper, zinc, yttrium, zirconium, niobium, molybdenum, technetium, ruthenium, rhodium, palladium, silver, cadmium, hafnium, tantalum, tungsten, rhenium, osmium, iridium, platinum, gold, mercury, rutherfordium, dubnium, seaborgium, bohrium, hassium, meitnerium, ununnilium, unununium, and ununbium. In one embodiment, a BMG containing a transition metal element can have at least one of Nb, Zr, Ni, and Cu. These transition metal elements can be classified into early transition metals or E™, or elements from Groups IVB and VB of the periodic table, (e.g., Zr and Nb), and late transition metals or L™, or elements from Groups VIIIB and IB (e.g., Cu and Ni). The bulk metallic glass alloys also may contain metal elements, such as Al.

The presently described alloy or alloy "sample" or "specimen" alloy can have any shape or size. For example, the alloy can have a shape of a particulate, which can have a shape such as spherical, ellipsoid, wire-like, rod-like, sheet-like, flake-like, or an irregular shape. The particulate can have any size. For example, it can have an average diameter of between about 1 micron and about 100 microns, such as between about 5 microns and about 80 microns, such as between about 10 microns and about 60 microns, such as between about 15 microns and about 50 microns, such as between about 15 microns and about 45 microns, such as between about 20 microns and about 40 microns, such as between about 25 microns and about 35 microns. For example, in one embodiment, the average diameter of the particulate is between about 25 microns and about 44 microns. In some embodiments, smaller particulates, such as those in the nanometer range, or larger particulates, such as those bigger than 100 microns, can be used.

The alloy sample or specimen can also be of a much larger dimension. For example, it can be a bulk structural component, such as an ingot, housing/casing of an electronic device or even a portion of a structural component that has dimensions in the millimeter, centimeter, or meter range.

Solid Solution

The term "solid solution" refers to a solid form of a solution. The term "solution" refers to a mixture of two or more substances, which may be solids, liquids, gases, or a combination of these. The mixture can be homogeneous or heterogeneous. The term "mixture" is a composition of two or more substances that are combined with each other and are generally capable of being separated. Generally, the two or more substances are not chemically combined with each other.

Alloy

In some embodiments, the alloy composition described herein can be fully alloyed. In one embodiment, an "alloy" refers to a homogeneous mixture or solid solution of two or more metals, the atoms of one replacing or occupying interstitial positions between the atoms of the other; for example, brass is an alloy of zinc and copper. An alloy, in contrast to a composite, can refer to a partial or complete solid solution of one or more elements in a metal matrix, such as one or more compounds in a metallic matrix. The term alloy herein can refer to both a complete solid solution alloy that can give single solid phase microstructure and a partial solution that can give two or more phases. An alloy composition described herein can refer to one comprising an alloy or one comprising an alloy-containing composite.

Thus, a fully alloyed alloy can have a homogenous distribution of the constituents, be it a solid solution phase, a compound phase, or both. The term "fully alloyed" used herein can account for minor variations within the error tolerance. For example, it can refer to at least 90% alloyed, such as at least 95% alloyed, such as at least 99% alloyed, such as at least 99.5% alloyed, such as at least 99.9% alloyed. The percentage herein can refer to either volume percent or weight percentage, depending on the context. These percentages can be balanced by impurities, which can be in terms of composition or phases that are not a part of the alloy.

Amorphous or Non-Crystalline Solid

An "amorphous" or "non-crystalline solid" is a solid that lacks lattice periodicity, which is characteristic of a crystal. As used herein, an "amorphous solid" includes "glass" which is an amorphous solid that softens and transforms into a liquid-like state upon heating through the glass transition. Generally, amorphous materials lack the long-range order characteristic of a crystal, though they can possess some short-range order at the atomic length scale due to the nature of chemical bonding. The distinction between amorphous solids and crystalline solids can be made based on lattice periodicity as determined by structural characterization techniques such as x-ray diffraction and transmission electron microscopy.

The terms "order" and "disorder" designate the presence or absence of some symmetry or correlation in a many-particle system. The terms "long-range order" and "short-range order" distinguish order in materials based on length scales.

The strictest form of order in a solid is lattice periodicity: a certain pattern (the arrangement of atoms in a unit cell) is repeated again and again to form a translationally invariant tiling of space. This is the defining property of a crystal. Possible symmetries have been classified in 14 Bravais lattices and 230 space groups.

Lattice periodicity implies long-range order. If only one unit cell is known, then by virtue of the translational symmetry it is possible to accurately predict all atomic positions at arbitrary distances. The converse is generally true, except, for example, in quasi-crystals that have perfectly deterministic tilings but do not possess lattice periodicity.

Long-range order characterizes physical systems in which remote portions of the same sample exhibit correlated behavior. This can be expressed as a correlation function, namely the spin-spin correlation function: $G(x, x')=\langle s(x), s(x')\rangle$.

In the above function, s is the spin quantum number and x is the distance function within the particular system. This function is equal to unity when $x=x'$ and decreases as the distance $|x-x'|$ increases. Typically, it decays exponentially to zero at large distances, and the system is considered to be disordered. If, however, the correlation function decays to a constant value at large $|x-x'|$, then the system can be said to possess long-range order. If it decays to zero as a power of the distance, then it can be called quasi-long-range order. Note that what constitutes a large value of $|x-x'|$ is relative.

A system can be said to present quenched disorder when some parameters defining its behavior are random variables that do not evolve with time (i.e., they are quenched or frozen)—e.g., spin glasses. It is opposite to annealed disorder, where the random variables are allowed to evolve themselves. Embodiments herein include systems comprising quenched disorder.

The alloy described herein can be crystalline, partially crystalline, amorphous, or substantially amorphous. For example, the alloy sample/specimen can include at least some crystallinity, with grains/crystals having sizes in the nanometer and/or micrometer ranges. Alternatively, the alloy can be substantially amorphous, such as fully amorphous. In one embodiment, the alloy composition is at least substantially not amorphous, such as being substantially crystalline, such as being entirely crystalline.

In one embodiment, the presence of a crystal or a plurality of crystals in an otherwise amorphous alloy can be construed as a "crystalline phase" therein. The degree of crystallinity (or "crystallinity" for short in some embodiments) of an alloy can refer to the amount of the crystalline phase present in the alloy. The degree can refer to, for example, a fraction of crystals present in the alloy. The fraction can refer to volume fraction or weight fraction, depending on the context. A measure of how "amorphous" an amorphous alloy is can be amorphicity. Amorphicity can be measured in terms of a degree of crystallinity. For example, in one embodiment, an alloy having a low degree of crystallinity can be said to have a high degree of amorphicity. In one embodiment, for example, an alloy having 60 vol % crystalline phase can have a 40 vol % amorphous phase.

Amorphous Alloy or Amorphous Metal

An "amorphous alloy" is an alloy having an amorphous content of more than 50% by volume, preferably more than 90% by volume of amorphous content, more preferably more than 95% by volume of amorphous content, and most preferably more than 99% to almost 100% by volume of amorphous content. Note that, as described above, an alloy high in amorphicity is equivalently low in degree of crystallinity. An "amorphous metal" is an amorphous metal material with a disordered atomic-scale structure. In contrast to most metals, which are crystalline and therefore have a highly ordered arrangement of atoms, amorphous alloys are non-crystalline. Materials in which such a disordered structure is produced directly from the liquid state during cooling are sometimes referred to as "glasses." Accordingly, amorphous metals are commonly referred to as "metallic glasses" or "glassy metals." In one embodiment, a bulk metallic glass ("BMG") can refer to an alloy, of which the microstructure is at least partially amorphous. However, there are several ways besides extremely rapid cooling to produce amorphous metals, including physical vapor deposition, solid-state reaction, ion irradiation, melt spinning, and mechanical alloying. Amorphous alloys can be a single class of materials, regardless of how they are prepared.

Amorphous metals can be produced through a variety of quick-cooling methods. For instance, amorphous metals can be produced by sputtering molten metal onto a spinning metal disk. The rapid cooling, on the order of millions of degrees a second, can be too fast for crystals to form, and the material is thus "locked in" a glassy state. Also, amorphous metals/alloys can be produced with critical cooling rates low enough to allow formation of amorphous structures in thick layers—e.g., bulk metallic glasses.

The terms "bulk metallic glass" ("BMG"), bulk amorphous alloy ("BAA"), and bulk solidifying amorphous alloy are used interchangeably herein. They refer to amorphous alloys having the smallest dimension at least in the millimeter range. For example, the dimension can be at least about 0.5 mm, such as at least about 1 mm, such as at least about 2 mm, such as at least about 4 mm, such as at least about 5 mm, such as at least about 6 mm, such as at least about 8 mm, such as at least about 10 mm, such as at least about 12 mm. Depending on the geometry, the dimension can refer to the diameter, radius, thickness, width, length, etc. A BMG can also be a metallic glass having at least one dimension in the centimeter range, such as at least about 1.0 cm, such as at least about 2.0 cm, such as at least about 5.0 cm, such as at least about 10.0 cm. In some embodiments, a BMG can have at least one dimension at least in the meter range. A BMG can take any of the shapes or forms described above, as related to a metallic glass. Accordingly, a BMG described herein in some embodiments can be different from a thin film made by a conventional deposition technique in one important aspect—the former can be of a much larger dimension than the latter.

Amorphous metals can be an alloy rather than a pure metal. The alloys may contain atoms of significantly different sizes, leading to low free volume (and therefore having viscosity up to orders of magnitude higher than other metals and alloys) in a molten state. The viscosity prevents the atoms from moving enough to form an ordered lattice. The material structure may result in low shrinkage during cooling and resistance to plastic deformation. The absence of grain boundaries, the weak spots of crystalline materials in some cases, may, for example, lead to better resistance to wear and corrosion. In one embodiment, amorphous metals, while technically glasses, may also be much tougher and less brittle than oxide glasses and ceramics.

Thermal conductivity of amorphous materials may be lower than that of their crystalline counterparts. To achieve formation of an amorphous structure even during slower cooling, the alloy may be made of three or more components, leading to complex crystal units with higher potential energy and lower probability of formation. The formation of amorphous alloy can depend on several factors: the composition of the components of the alloy; the atomic radius of the components (preferably with a significant difference of over 12% to achieve high packing density and low free volume); and the negative heat of mixing the combination of components, inhibiting crystal nucleation and prolonging the time the molten metal stays in a supercooled state. However, as the formation of an amorphous alloy is based on many different variables, it can be difficult to make a prior determination of whether an alloy composition would form an amorphous alloy.

Amorphous alloys, for example, of boron, silicon, phosphorus, and other glass formers with magnetic metals (iron, cobalt, nickel) may be magnetic, with low coercivity and high electrical resistance. The high resistance leads to low losses by eddy currents when subjected to alternating magnetic fields, a property useful, for example, as transformer magnetic cores.

Amorphous alloys may have a variety of potentially useful properties. In particular, they tend to be stronger than crystalline alloys of similar chemical composition, and they can sustain larger reversible ("elastic") deformations than crystalline alloys. Amorphous metals derive their strength directly from their non-crystalline structure, which can have none of the defects (such as dislocations) that limit the strength of crystalline alloys. For example, one modern amorphous metal, known as Vitreloy™, has a tensile strength that is almost twice that of high-grade titanium. In some embodiments, metallic glasses at room temperature are not ductile and tend to fail suddenly when loaded in tension, which limits the material applicability in reliability-critical applications, as the impending failure is not evident. Therefore, to overcome this challenge, metal matrix composite materials having a metallic glass matrix containing dendritic particles or fibers of a ductile crystalline metal can be used. Alternatively, a BMG low in element(s) that tend to cause embitterment (e.g., Ni) can be used. For example, a Ni-free BMG can be used to improve the ductility of the BMG.

Another useful property of bulk amorphous alloys is that they can be true glasses; in other words, they can soften and flow upon heating. This can allow for easy processing, such as by injection molding, in much the same way as polymers. As a result, amorphous alloys can be used for making sports equipment, medical devices, electronic components and equipment, and thin films. Thin films of amorphous metals can be deposited as protective coatings via a high velocity oxygen fuel technique.

A material can have an amorphous phase, a crystalline phase, or both. The amorphous and crystalline phases can have the same chemical composition and differ only in the microstructure—i.e., one amorphous and the other crystalline. Microstructure in one embodiment refers to the structure of a material as revealed by a microscope at 25× magnification or higher. Alternatively, the two phases can have different chemical compositions and microstructures. For example, a composition can be partially amorphous, substantially amorphous, or completely amorphous.

As described above, the degree of amorphicity (and conversely the degree of crystallinity) can be measured by fraction of crystals present in the alloy. The degree can refer to volume fraction of weight fraction of the crystalline phase present in the alloy. A partially amorphous composition can refer to a composition of at least about 5 vol % of which is of an amorphous phase, such as at least about 10 vol %, such as at least about 20 vol %, such as at least about 40 vol %, such as at least about 60 vol %, such as at least about 80 vol %, such as at least about 90 vol %. The terms "substantially" and "about" have been defined elsewhere in this application. Accordingly, a composition that is at least substantially amorphous can refer to one of which at least about 90 vol % is amorphous, such as at least about 95 vol %, such as at least about 98 vol %, such as at least about 99 vol %, such as at least about 99.5 vol %, such as at least about 99.8 vol %, such as at least about 99.9 vol %. In one embodiment, a substantially amorphous composition can have some incidental, insignificant amount of crystalline phase present therein.

In one embodiment, an amorphous alloy composition can be homogeneous with respect to the amorphous phase. A substance that is uniform in composition is homogeneous. This is in contrast to a substance that is heterogeneous. The term "composition" refers to the chemical composition and/or microstructure in the substance. A substance is homogeneous when a volume of the substance is divided in half and both halves have substantially the same composition. For example, a particulate suspension is homogeneous when a volume of the particulate suspension is divided in half and both halves have substantially the same volume of particles. However, it might be possible to see the individual particles under a microscope. Another example of a homogeneous substance is air where different ingredients therein are equally suspended, though the particles, gases and liquids in air can be analyzed separately or separated from air.

A composition that is homogeneous with respect to an amorphous alloy can refer to one having an amorphous phase substantially uniformly distributed throughout its microstructure. In other words, the composition macroscopically comprises a substantially uniformly distributed amorphous alloy throughout the composition. In an alternative embodiment, the composition can be of a composite, having an amorphous phase having therein a non-amorphous phase. The non-amorphous phase can be a crystal or a plurality of crystals. The crystals can be in the form of particulates of any shape, such as spherical, ellipsoid, wire-like, rod-like, sheet-like, flake-like, or an irregular shape. In one embodiment, it can have a dendritic form. For example, an at least partially amorphous composite composition can have a crystalline phase in the shape of dendrites dispersed in an amorphous phase matrix; the dispersion can be uniform or non-uniform, and the amorphous phase and the crystalline phase can have the same or a different chemical composition. In one embodiment, they have substantially the same chemical composition. In another embodiment, the crystalline phase can be more ductile than the BMG phase.

In some embodiments, a composition having an amorphous alloy can include a small amount of impurities. The impurity elements can be intentionally added to modify the properties of the composition, such as improving the mechanical properties (e.g., hardness, strength, fracture mechanism, etc.) and/or improving the corrosion resistance. Alternatively, the impurities can be present as inevitable, incidental impurities, such as those obtained as a byproduct of processing and manufacturing. The impurities can be less than or equal to about 10 wt %, such as about 5 wt %, such as about 2 wt %, such as about 1 wt %, such as about 0.5 wt %, such as about 0.1 wt %. In some embodiments, these percentages can be volume percentages instead of weight percentages. In one embodiment, the alloy sample/composition consists essentially of the amorphous alloy (with only a small incidental amount of impurities). In another embodiment, the composition includes the amorphous alloy (with no observable trace of impurities).

In embodiments herein, the existence of a supercooled liquid region in which the bulk metallic glass alloy can exist as a high viscous liquid allows for superplastic forming. Large plastic deformations can be obtained. The ability to undergo large plastic deformation in the supercooled liquid region could be used for the forming and/or cutting process. As opposed to solids, the liquid bulk metallic glass alloy deforms locally which drastically lowers the required energy for cutting and forming. The ease of cutting and forming depends on the temperature of the alloy, the mold, and the cutting tool. As higher is the temperature, the lower is the viscosity, and consequently easier is the cutting and forming.

Electronic Devices

The embodiments herein can be valuable in the fabrication of electronic devices using a BMG. An electronic device herein can refer to any electronic device known in the art. For example, it can be a telephone, such as a cell phone, and a land-line phone, or any communication device, such as a smart phone, including, for example an iPhone™, and an electronic email sending/receiving device. It can be a part of a display, such as a digital display, a TV monitor, an electronic-book reader, a portable web-browser (e.g., iPad™), and a computer monitor. It can also be an entertainment device, including a portable DVD player, conventional DVD player, Blu-Ray disk player, video game console, music player, such as a portable music player (e.g., iPod™), etc. It can also be a part of a device that provides control, such as controlling the streaming of images, videos, sounds (e.g., Apple TV™), or it can be a remote control for an electronic device. It can be a part of a computer or its accessories, such as the hard drive tower housing or casing, laptop housing, laptop keyboard, laptop track pad, desktop keyboard, mouse, and speaker. The article can also be applied to a device such as a watch or a clock.

Specific Alloy Compositions

The embodiments provide a bulk metallic glass composition containing $Zr_aNb_bCu_cNi_dAl_e$, wherein a-e represent the atomic percentage of each respective element, and wherein b/a is less than about 0.040, and c/d is less than 1.15. Another embodiment provides a bulk metallic glass alloy having the composition $Zr_{61.45}Nb_{1.75}Cu_{1.35}Ni_{12.6}Al_{10.0}$.

It is known to create a Zr—Nb—Cu—Ni—Al alloy bulk metallic glass by injecting the molten liquid metal into a split metal mold at room temperature. One example is the alloy $Zr_{57}Nb_5Cu_{15.4}$ $Ni_{12.6}$ $Al_{10}$, referred to as alloy A3 in U.S. Pat. No. 6,592,689, the disclosure of which is incorporated by reference in its entirety. The '689 patent states that the A3 alloy exhibits a good glass forming ability, and also has excellent thermal stability with respect to crystallization. For example, this alloy has a supercooled liquid region a $\Delta T=Tx-Tg$ of about 70 degrees Kelvin, where Tg is the glass transition temperature, and Tx is the glass crystallization temperature. Conventional techniques have not been very successful at vitrifying this alloy. Conventional metal forming techniques may cool from the liquid state to the solid state at less than 10K per second for specimens with masses that are greater than 5 g. Such conventional metal forming techniques may include arc melting on a water cooled Cu hearth, or melting in a "silver boat." Because of this, it has been relatively difficult to vitrify A3 alloy specimens using these conventional techniques.

The '689 patent sought to improve upon the A3 alloy, and modified the composition in accordance with certain criteria that are employed in the development of bulk metallic glasses; e.g., compositions are close to deep eutectics, and often exhibit large reduced glass transition temperatures. Closely tied to this condition is the role of the individual ETM (i.e., early transition metal) and LTM (i.e., late transition metals) constituents, and their combinatory effect on frustration of the competing crystalline phases which in turn limit the GFA for a given alloy composition. This destabilization of the crystalline phases that limit the GFA stems from fundamental considerations; e.g., the rules of Hume-Rothery. The '689 patent states that the first of these rules, the size factor, suggests that the solid solubility of one metal in another is restricted when their atomic radii differ by more that 15%. This criterion for extensive solid solubility is directly related to the strains produced in the lattice of the solvent by the solute atoms. In the ternary Zr—Ti-LTM, with LTM=Cu+Ni BMG alloys, there are only a few crystalline phases that act to limit the GFA for a given alloy composition. As it turns out, these phases have a rather global characteristic and are identified by x-ray diffraction measurements in specimens not fully vitrified on cooling from the liquid state. Examples of these are; $ZrTiCu_2Ti_2Cu$, $Zr_2Cu$, each with "E93" or $MoSi_2$ symmetry. Outside critical ranges of solubility these competing crystalline phases are topologically unstable in comparison to a transition to the vitreous state.

The '689 patent sought to examine the effect of small variations in composition within the higher order quinary (Zr—Nb—Cu—Ni—Al) system, and proposed an investigation by varying certain amounts of the respective elements. The '689 patent examined compositions having the following structure: $Zr_{57+\delta/2}$ $Nb_{5-\delta}$ $Cu_{15.4}$ $Ni_{12.6}$ $Al_{10+\delta/2}$ where $\delta$ is less than 2.5, and preferably between 0.25 and 0.75. The '689 patent discovered an alloy having the following composition, which it alleges has a super cooled liquid region $\Delta T=Tx-Tg$ of about 98: $Zr_{58.47}$ $Nb_{2.76}$ $Cu_{15.4}$ $Ni_{12.6}$ $Al_{10.37}$. The present inventors attempted to replicate this alloy, but were unable to produce the alloy having the aforementioned composition and the super cooled liquid region.

The present inventors surprisingly found that varying the amounts of the respective elements of the Zr—Nb—Cu—Ni—Al system well outside the ranges mentioned in the '689 patent, and in direct contradistinction to the teachings therein, can produce a bulk metallic glass having a super cooled liquid region of above 95° C. The embodiments therefore provide a bulk metallic glass composition $Zr_aNb_bCu_cNi_dAl_e$, wherein a-e represent the atomic percentage of each respective element, and wherein b/a is less than about 0.040, or less than about 0.0325, or less than about 0.030, or about 0.0285, and c/d is less than 1.15, or less than about 1.10, or less than about 1.05, or about 1.02. A particularly preferred bulk metallic glass alloy has the composition $Zr_{61.45}Nb_{1.75}Cu_{13.5}Ni_{12.6}Al_{10.0}$. The ratio of b/a can be within the range of from about 0.015 to about 0.04, or between about 0.020 to about 0.0325, or from about 0.025 to about 0.030, and the ratio of c/d can be within the range of from about 0.90 to about 1.15, or from about 0.97 to about 1.10, or from about 1.00 to about 1.05.

Another embodiment provides a method of forming a bulk metallic glass alloy by forming a bulk metallic glass of the following composition $Zr_aNb_bCu_cNi_dAl_e$, wherein a-e represent the atomic percentage of each respective element, by adjusting the ratio of b/a to be less than about 0.040, or less than about 0.0325, or less than about 0.030, or about 0.0285, and adjusting the ratio of c/d to be less than 1.15, or less than about 1.10, or less than about 1.05, or about 1.02.

Adjusting the ratios of the respective elements to be within the ranges described above provides a bulk metallic glass alloy having improved thermal stability and improved processability. The super cooled liquid region $\Delta T$ of the bulk metallic glass alloy can be within the range of from about 80 to about 250° C., or from about 90 to about 150° C., or from about 95 to about 110° C. These high values for $\Delta T$ render the alloy more thermally stable, and more capable of processing using thermoplastic forming operations because the operating window is that much greater, when compared to the conventional Zr—Nb—Cu—Ni—Al alloy described in the '689 patent, which has a $\Delta T$ on the order of about 70° C.

For example, FIG. 1 depicts a DSC (i.e., differential scanning calorimetry) thermogram of an exemplary alloy containing $Nb_{1.75}$ in accordance with various embodiments of the present teachings. This DSC thermogram was obtained from a 5 mm diameter rod of the disclosed alloy containing $Nb_{1.75}$ that is cast into an H13 tool steel mold from above the melting point. Generally, the heat capacity of a sample can be calculated from the shift in the baseline at the starting transient of a DSC thermogram. The glass transition may cause a baseline shift. Crystallization is an exothermic process and melting is an endothermic process, as shown in FIG. 1.

While the principles of the disclosure have been made clear in the illustrative embodiments set forth above, it will be apparent to those skilled in the art that various modifications may be made to the structure, arrangement, proportion, elements, materials, and components used in the practice of the disclosure.

It will be appreciated that a variety of the above-disclosed and other features and functions, or alternatives thereof, may be desirably combined into many other different systems/devices or applications. Various presently unforeseen or unanticipated alternatives, modifications, variations, or improvements therein may be subsequently made by those skilled in the art which are also intended to be encompassed by the following claims.

What is claimed is:

1. A bulk metallic glass alloy having the following composition $Zr_{61.45}Nb_{1.75}Cu_{13.5}Ni_{12.6}Al_{10.0}$.

2. A method of forming a bulk metallic glass alloy comprising:

forming a bulk metallic glass of the composition $Zr_{61.45}Nb_{1.75}Cu_{13.5}Ni_{12.6}Al_{10.0}$.

* * * * *